US008005245B2

(12) United States Patent
Iida et al.

(10) Patent No.: US 8,005,245 B2
(45) Date of Patent: Aug. 23, 2011

(54) SOUND IMAGE LOCALIZATION APPARATUS

(75) Inventors: Kazuhiro Iida, Kanagawa (JP); Gempo Ito, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1189 days.

(21) Appl. No.: 11/574,410

(22) PCT Filed: Sep. 8, 2005

(86) PCT No.: PCT/JP2005/016524

§ 371 (c)(1),
(2), (4) Date: Feb. 28, 2007

(87) PCT Pub. No.: WO2006/030692

PCT Pub. Date: Mar. 23, 2006

(65) Prior Publication Data

US 2009/0034772 A1 Feb. 5, 2009

(30) Foreign Application Priority Data

Sep. 16, 2004 (JP) ..... 2004-270316

(51) Int. Cl.
*H04R 5/02* (2006.01)
*H04R 5/00* (2006.01)

(52) U.S. Cl. ..... 381/310; 381/17

(58) Field of Classification Search ..... 381/17, 381/18, 19, 310, 61, 63; 84/630
See application file for complete search history.

(56) References Cited

U.S. PATENT DOCUMENTS 6,430,294 B1 * 8/2002 Fujita et al. ..... 381/17

FOREIGN PATENT DOCUMENTS

| | | | |
|---|---|---|---|
| EP | 0 276 159 | A2 | 1/1988 |
| JP | 55141898 | A | 11/1980 |
| JP | 1051900 | A | 2/1998 |
| JP | 2003230199 | A | 8/2003 |
| JP | 2004-135023 | A | 4/2004 |

OTHER PUBLICATIONS

Jens Blauert, Masayuki Morimoto, Toshiyuki Goto, "Spatial Acoustics", Kajima Institute Publishing Co., Ltd., Jul. 10, Showa 61.
International Search Report, dated Dec. 6, 2005.
European Search Report dated Sep. 24, 2009.

* cited by examiner

*Primary Examiner* — Curtis Kuntz
*Assistant Examiner* — Hai Phan
(74) *Attorney, Agent, or Firm* — Pearne & Gordon LLP

(57) ABSTRACT

It is an object of the present invention to provide a sound image localization apparatus which can localize a sound image with ease correctly for many listeners.

Herein disclosed is a sound image localization apparatus, in which a directional band information storage unit 11 is adapted to store therein directional bands in advance calculated for respective directions, a control filter computing unit 12 is adapted to read a directional band corresponding to a target position information from a directional band information storage unit 11 upon receiving target position information, calculate a control filter coefficient in such a manner that the maximum value of a sensation level for which masking is taken into consideration is matched with the directional band thus read, output the control filter coefficient to a sound image localization processing unit 13. Upon receiving the control filter coefficient from the control filter computing unit 12, the sound image localization processing unit 13 is adapted to convolve the control filter coefficient thus received to an inputted sound source signal, carry out sound image localization processing on the sound source signal, and output a sound signal whose sound image has been localized as a sound image localization signal to a sound reproducing device, not shown, such as, for example, headphones, a speaker, and/or the like.

16 Claims, 15 Drawing Sheets

Rising angle indicative of sound source position with front direction of median plane being zero degree Rising angle indicative of sound source position with front direction of median plane being zero degree Prior Art

SOUND IMAGE LOCALIZATION APPARATUS

TECHNICAL FIELD OF THE INVENTION

The present invention relates to a sound image localization apparatus for localizing a sound image at an arbitrary position in a three-dimensional space.

DESCRIPTION OF THE RELATED ART

Up until now, numerous researches have been conducted for technologies to localize a sound image at an arbitrary position in a three-dimensional space using a sound reproducing device such as, for example, a speaker, headphones, or the like.

Owing to those researches, it has become apparent that a sound image can be localized at a desired position, by precisely reproducing sound transfer characteristics from a position at which the sound image is to be localized to ears of a listener, and convolving the sound transfer characteristics to a sound source signal, to be audibly outputted to the listener.

The sound transfer characteristics are divided into, for example, a spatial transfer function indicative of characteristics of reflection, diffraction, dispersion occurred at, for example, a wall, and/or the like, and a head-related transfer function indicative of transfer characteristics of reflection, diffraction, dispersion occurred at, for example, a head and a body of a listener, and/or the like.

Among others, regarding sound image localization using the head-related transfer function, it has become apparent that a sound image can be localized at a desired position, by precisely reproducing a head-related transfer function of a listener, and convolving the head-related transfer function to a sound source signal, to be audibly outputted to the listener (see, for example, Non Patent Document 1).

The conventional sound image localization apparatus using the head-related transfer function of this type may localize a sound image by accurately measuring a head-related transfer function specific to each of listeners and precisely reproducing the head-related transfer function thus measured, or simply using a standard head-related transfer function common to all of listeners.

FIG. 15 is a block diagram showing a conventional sound image localization apparatus.

As shown in FIG. 15, the conventional sound image localization apparatus comprises a head-related transfer function storage unit 61 for storing therein head-related transfer functions each created to a direction to which a sound image is desired to be localized, a head-related transfer function selecting unit 62 for selecting a head-related transfer function based on information of a target position at which the sound image is to be localized, and a sound image localization processing unit 63 for carrying out sound image localization processing in accordance with the head-related transfer function thus selected, and outputting a sound signal thus processed.

Here, the head-related transfer functions stored in the head-related transfer function storage unit 61 may be specific to respective listeners or common to all of listeners.

In the conventional sound image localization apparatus thus constructed, an inputted sound source signal is convolved with a head-related transfer function selected based on inputted target position information, and then outputted as a sound image localization signal, which is a sound signal whose sound image is localized, to a sound reproducing device such as, for example, headphones, a speaker, and/or the like.

As will be understood from the foregoing description, in the conventional sound image localization apparatus, a sound image can be localized using a head-related transfer function specific to each or listeners, or common to all of listeners.

Non Patent Document 1: "Spatial Hearing" written by Jens Blauert, MIT PRESS, 1983.

SUMMARY OF THE INVENTION

Problems to be Solved by the Invention

The conventional sound image localization apparatus using the head-related transfer function, however, encounters three drawbacks.

Firstly, it has become apparent that head-related transfer functions vary between individuals, and a sound image may not be localized correctly at a target position if a head-related transfer function not fitted to a listener is used. Accordingly, a drawback is encountered in that the conventional sound image localization apparatus using the standard head-related transfer function common to all of listeners cannot localize a sound image correctly for some listeners. Especially in this case, it is known that a position at which the sound image is localized becomes different in for- and backward and up- and downward directions from a target position.

Secondly, specialized equipment is required to measure a head-related transfer function, and thus, it is practically impossible to measure head-related transfer functions to all of listeners in person. Accordingly, another drawback is encountered in that it is far from easy to manufacture a sound image localization apparatus using a head-related transfer function specific to each of listeners in person.

A further drawback is encountered in that a sound image cannot be localized correctly at a target position although sound image localizing processing may be carried out, in the case that an inputted sound source signal includes cue information of sound image localization, which indicates a position, at which a sound image is to be localized, different from a target position.

The present invention is made for the purpose of overcoming the aforementioned drawbacks, and it is an object of the present invention to provide a sound image localization apparatus which can localize a sound image correctly for many listeners with ease.

Means for Solving the Problems

In accordance with a first aspect of the present invention, there is provided a sound image localization apparatus, comprising: directional band information storage means for storing therein information of directional bands; control filter computing means for reading said directional band corresponding to an inputted target position from said directional band information storage means, and computing a control filter coefficient based on said directional band thus read and a sensation level for which masking is taken into consideration; and sound image localization processing means for carrying out sound image localization processing on an inputted sound source signal using said control filter coefficient.

In the sound image localization apparatus according to the present invention thus constructed, a control filter coefficient is calculated based on the directional band corresponding to the inputted target position and the sensation level for which masking is taken into consideration, and sound image localization processing is carried out using the control filter coefficient thus calculated. This leads to the fact that the sound image localization apparatus according to the present invention can easily and correctly localize a sound image without using any head-related transfer function.

Further, in the sound image localization apparatus according to the present invention, said control filter computing means may calculate said control filter coefficient in such a manner that a frequency at which said sensation level for which masking is taken into consideration is maximized is matched with said directional band corresponding to said target position.

In the sound image localization apparatus according to the present invention thus constructed, the control filter coefficient is calculated in such a manner that a frequency at which the sensation level for which masking is taken into consideration is maximized is matched with the directional band corresponding to said target position. This leads to the fact that the sound image localization apparatus according to the present invention can easily and correctly localize a sound image without using any head-related transfer function.

Further, the sound image localization apparatus thus constructed may further comprise: head-related transfer function storage means for storing therein head-related transfer functions, and in which said control filter computing means may calculate said control filter coefficient based on a head-related transfer function obtained from said head-related transfer function storage means, said sensation level for which masking is taken into consideration, and said directional band corresponding to said target position.

In the sound image localization apparatus according to the present invention thus constructed, the control filter coefficient is calculated based on the head-related transfer function, the directional band corresponding to the inputted target position, and the sensation level for which masking is taken into consideration, and sound image localization processing is carried out using the control filter coefficient thus calculated. This leads to the fact that the sound image localization apparatus according to the present invention can easily and correctly localize a sound image without using any head-related transfer function specific to the target position.

Further, in the sound image localization apparatus according to the present invention, said control filter computing mean may calculate said control filter coefficient in such a manner that a frequency at which said sensation level for which masking is taken into consideration calculated from said head-related transfer function is maximized is matched with said directional band corresponding to said target position.

In the sound image localization apparatus according to the present invention thus constructed, the control filter coefficient is calculated after the head-related transfer function is corrected using the sensation level for which masking is taken into consideration and the directional band corresponding to said target position. This leads to the fact that the sound image localization apparatus according to the present invention can easily and correctly localize a sound image with only an in-advance prepared standard head-related transfer function.

Further, in the sound image localization apparatus according to the present invention, said control filter computing means may divide at least one of said sensation level for which masking is taken into consideration and said directional band corresponding to said target position for a plurality of bands, and calculate said control filter coefficient based on a band level or band information of each of respective bands.

In the sound image localization apparatus according to the present invention thus constructed, at least one of the sensation level for which masking is taken into consideration and the directional band corresponding to said target position is divided for a plurality of bands, and the control filter coefficient is calculated for each of the bands. This leads to the fact that the sound image localization apparatus according to the present invention can easily and correctly localize a sound image by calculating the control filter coefficient for simpler frequency characteristics.

Further, in the sound image localization apparatus according to the present invention, said control filter computing means may divide at least one of said head-related transfer function, said sensation level for which masking is taken into consideration and said directional band corresponding to said target position for a plurality of bands, and calculate said control filter coefficient based on a band level or band information of each of respective bands.

In the sound image localization apparatus according to the present invention thus constructed, at least one of the head-related transfer function, the sensation level for which masking is taken into consideration, ant the directional band corresponding to said target position is divided into a plurality of bands, and the control filter coefficient is calculated for each of the bands. This leads to the fact that the sound image localization apparatus according to the present invention can easily and correctly localize a sound image by calculating the control filter coefficient for simpler frequency characteristics.

Further, in the sound image localization apparatus, said control filter computing means may calculate said control filter coefficient based on frequency characteristics of said sound source signal in such a manner that a maximum value of sensation level for which masking is taken into consideration disposed in a band other than said directional band corresponding to said target position is suppressed.

In the sound image localization apparatus according to the present invention thus constructed, any peak level of the sound source signal disposed in a band other than the directional band is suppressed. This leads to the fact that the sound image localization apparatus according to the present invention can correctly localize a sound image regardless of the sound source signal.

Further, in the sound image localization apparatus according to the present invention, said control filter computing means may compare sensation level for which masking is taken into consideration disposed in a band other than said directional band corresponding to said target position with a predetermined value based on frequency characteristics of said sound source signal, and suppress said sensation level for which masking is taken into consideration judged as being greater than said predetermined value.

In the sound image localization apparatus according to the present invention thus constructed, any peak level of the sound source signal disposed in a band other than the directional band is suppressed. This leads to the fact that the sound image localization apparatus according to the present invention can correctly localize a sound image regardless of the sound source signal.

Further, in the sound image localization apparatus, said control filter computing means may divide frequency characteristics of said sound source signal for a plurality of bands, and calculate said control filter coefficient based on a band level or band information of each of respective bands.

In the sound image localization apparatus according to the present invention thus constructed, the frequency characteristics of the sound source signal is divided for a plurality of bands, and the control filter coefficient is calculated for each of the bands. This leads to the fact that the sound image localization apparatus according to the present invention can easily and correctly localize a sound image by calculating the control filter coefficient for simpler frequency characteristics.

Further, in the sound image localization apparatus, said control filter computing means may calculate, as said control filter coefficient, a control filter coefficient adapted to suppress at least either one of bands respectively disposed at both ends of said directional band corresponding to said target position.

The sound image localization apparatus according to the present invention thus constructed can easily and correctly localize a sound image by calculating a simpler control filter coefficient.

Further, in the sound image localization apparatus according to the present invention, said control filter computing means may divide said control filter coefficient for a plurality of bands, and calculate said control filter coefficient for each of said bands.

In the sound image localization apparatus according to the present invention, the control filter coefficient is divided and calculated for a plurality of bands. The sound image localization apparatus according to the present invention thus constructed can easily and correctly localize a sound image by calculating the control filter coefficient for simpler frequency characteristics.

Further, in the sound image localization apparatus according to the present invention, said directional band information storage means may store therein said directional band information in association with a plurality of listener groups respectively classified based on listener's characteristics, and which may further comprise directional band information selecting means for having said directional band information storage means select suitable directional band information from among said directional band information in association with said plurality of listener groups in accordance with inputted listener's characteristics.

In the sound image localization apparatus according to the present invention, the directional band information suitable for the listener's characteristics is selected, and then the control filter coefficient is calculated. The sound image localization apparatus according to the present invention thus constructed can easily and correctly localize a sound image for many people.

Further, in the sound image localization apparatus according to the present invention, said directional band information storage means is operative to store therein said directional band information in association with a plurality of listener groups respectively classified in accordance with listener's physical characteristics.

In the sound image localization apparatus according to the present invention thus constructed, the directional band information suitable to the listener's physical characteristics is selected, and then the control filter coefficient is calculated. The sound image localization apparatus according to the present invention thus constructed can easily and correctly localize a sound image for many people.

Further, in the sound image localization apparatus according to the present invention, said directional band information selecting means may extract said physical characteristics from inputted image data indicative of a listener, and have said directional band information storage means select suitable directional band information from among said directional band information in association with said plurality of listener groups based on said physical characteristics thus extracted.

In the sound image localization apparatus according to the present invention thus constructed, the physical characteristics is extracted from the inputted image data indicative of the listener, the directional band information suitable to the listener's physical characteristics thus extracted is selected, and then the control filter coefficient is calculated. The sound image localization apparatus according to the present invention thus constructed can easily and correctly localize a sound image for many people.

Further, the sound image localization apparatus may further comprise sound source signal correcting means for frequency-analyzing an inputted sound source signal, and correcting said sound source signal by suppressing cue information contained in said sound source signal, which causes a sound image to be localized at a position different from said target position, and in which sound image localization processing means may carry out sound image localization processing on said sound source signal corrected by said sound source signal correcting means.

The sound image localization apparatus according to the present invention can easily localize a sound image at a target position regardless of the sound source signal, resulting from the fact that the sound source signal is frequency-analyzed and, if it is found that the sound source signal has any peak in any part, the peak is suppressed before the control filter coefficient is convolved to the sound source signal.

Further, in the sound image localization apparatus according to the present invention, said sound source signal correcting means may frequency-analyze an inputted sound source signal, comparing a band level of said sound source signal with a predetermined value in each of bands, and correcting said sound source signal by suppressing said band levels judged as being greater than said predetermined value in respective bands if there are any bands whose band levels are judged as being greater.

The sound image localization apparatus according to the present invention thus constructed can easily localize a sound image at a target position regardless of the sound source signal, resulting from the fact that the sound source signal is frequency-analyzed and, if it is found that the sound source signal has any peak in any part, the peak is suppressed before the control filter coefficient is convolved to the sound source signal.

Further, in the sound image localization apparatus according to the present invention, said sound source signal correcting means may frequency-analyze an inputted sound source signal, calculating sensation levels in consideration of masking of the sound source signal in respective bands, comparing each of said sensation levels with a predetermined value in each of bands, and correcting said sound source signal by suppressing said sensation levels judged as being greater than said predetermined value in respective bands if there are any sensation levels in bands judged as being greater.

In the sound image localization apparatus according to the present invention can easily localize a sound image at a target position regardless of the sound source signal, resulting from the fact that the sound source signal is frequency-analyzed and, if it is found that the sound source signal has any peak in any part, the peak is suppressed before the control filter coefficient is convolved to the sound source signal.

In the sound image localization apparatus according to the present invention, said directional band information storage means and said control filter computing means may constitute a sound image localization assisting apparatus, and said sound image localization assisting apparatus may communicate with said sound image localization processing means to transmit said filter coefficient to said sound image localization processing means.

The sound image localization apparatus according to the present invention thus constructed makes it possible for parts to be mounted on ears to be constructed small in size, resulting from the fact that the sound image localization processing unit and the sound image localization assisting apparatus can be constructed and disposed separately from each other, and the sound image localization assisting apparatus can remotely provide a calculated filter coefficient to the sound image localization processing unit.

Advantageous Effect of the Invention

According to the present invention, a control filter coefficient capable of generating a sound image at a target position can be calculated based on sensation level for which masking is taken into consideration and directional band, thereby enabling to localize a sound image easily and correctly for many listeners.

EXPLANATION OF THE REFERENCE NUMERALS

Figure 1:
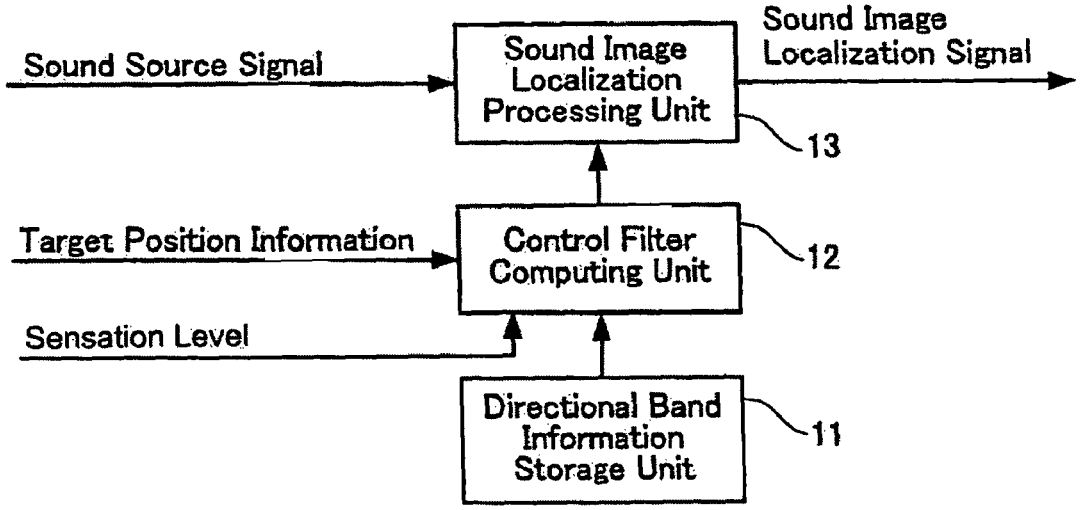
FIG. 1 is a block diagram showing a first preferred embodiment of a sound image localization apparatus according to the present invention.

11: directional band information storage unit (directional band information storage means)
12: control filter computing unit (control filter computing means)
13: sound image localization processing unit (sound image localization processing means)
21: directional band information storage unit (directional band information storage means)
22: directional band information selecting unit (directional band information selecting means)
31: control filter computing unit (control filter computing means)
32: head-related transfer function storage unit (head-related transfer function storage means)
41, 42: control filter computing unit (control filter computing means)
51: sound source signal correcting unit (sound source signal correcting means)
61: head-related transfer function storage unit
62: head-related transfer function selecting unit
63: sound image localization processing unit

DESCRIPTION OF THE PREFERRED EMBODIMENTS

The description hereinafter will be directed to a theory of cue information to be used to localize a sound image, which forms the basis of the present invention.

It is thought that cue information to be used for localizing a sound image is contained in a head-related transfer function since a sound image can be localized at an arbitrary position if the head-related transfer function is precisely reproduced as explained in the description of the related art.

According to the aforementioned Non Patent Document 1, it is thought, among cue information to be used to localize a sound image, cue information mainly related to localization in for- and backward and up- and downward directions is contained in an amplitude spectrum of a head-related transfer function, and numerous researches have been conducted for clarifying the cue information to be used to localize a sound image.

As one example, Blauert indicated that a direction of a sound image is perceived depending upon a central frequency of a stimulus regardless of the direction of its sound source when a narrow-band noise is presented in the median plane ("Sound localization in the median plane," Acustica, vol. 22, pp. 205-213, 1969/70). Blauert defines the frequency band which determines the direction of the sound image as a directional band.

Further, Blauert proposes a hypothesis that the direction of the sound image is perceived depending upon a boosted band of the head-related transfer function, and the direction is identical with the direction of the directional band, even in the case that the sound source is a broad-band signal.

However, the directional band indicated by Blauert is made simply by adding up experimental results of all of persons being tested, and likewise, the boosted band is made based on the average value of head-related transfer functions. Accordingly, individual variability in the head-related transfer function is not considered, and the relationship between the directional band and the head-related transfer function cannot be clarified.

The inventor of the present application analyzed the relationship between the directional band and the boosted band of the head-related transfer function for each of persons being tested. As a result of the analysis, it is unveiled that the boosted band of the head-related transfer function and directional band of its direction become different from each other in the case that the frequency band is equal to or greater than 5 kHz.

Figure 12:
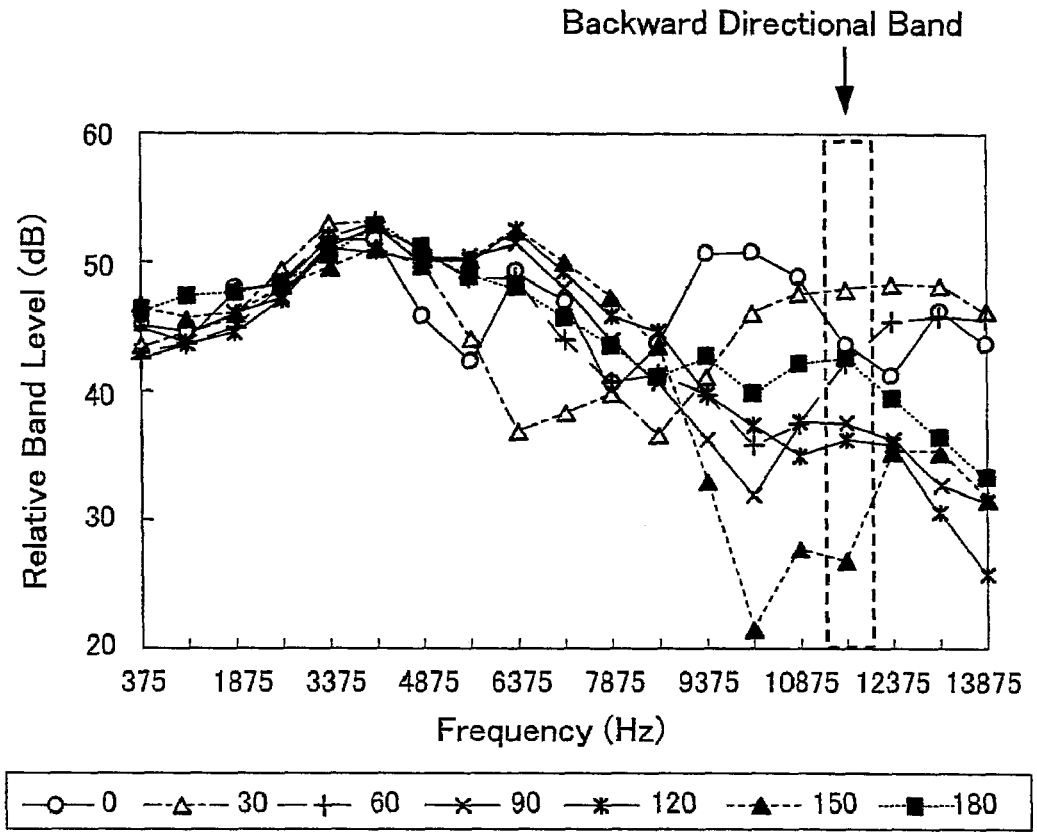
FIG. 12 is a graph showing an example of band levels and a directional band calculated from the head-related transfer function.

As an example, band levels calculated based on the head-related transfer function of a person being tested and the directional band of the backward direction are shown in FIG. 12. Each line indicates a band level being varied as the position of the sound source is moved upwardly in units of 30 degrees from the front direction of the median plane being zero degree.

Figure 13:
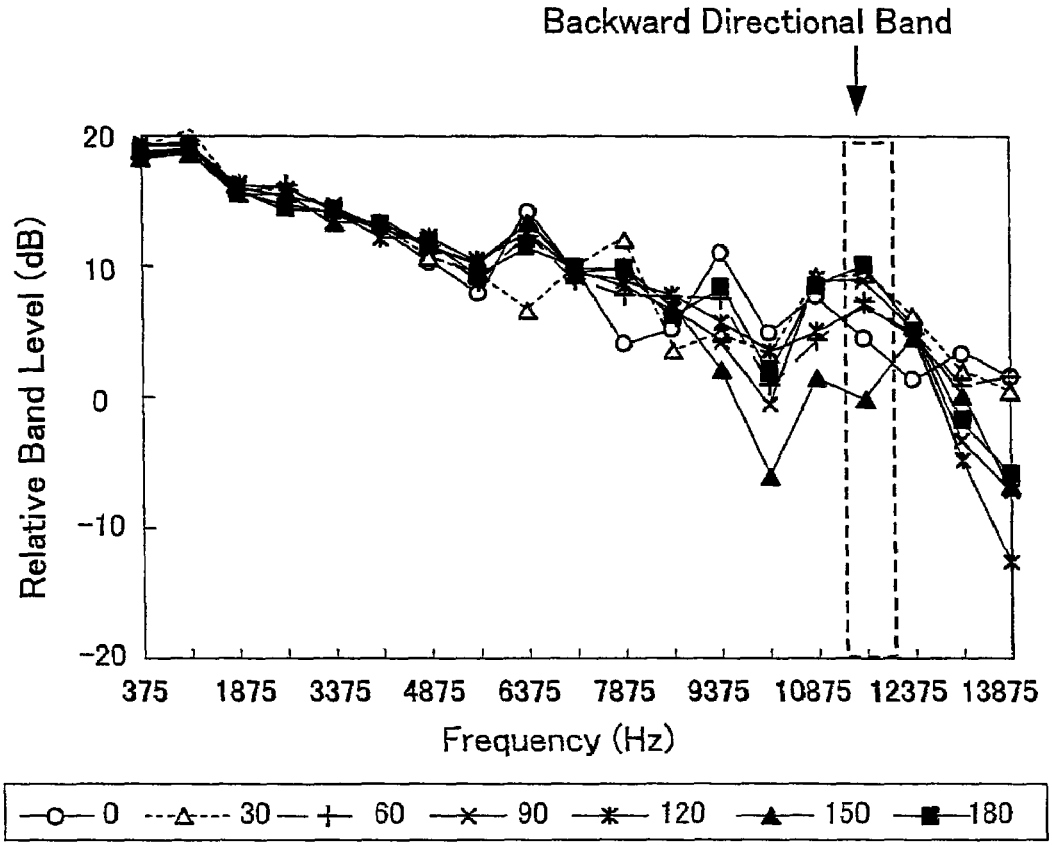
FIG. 13 is a graph showing sensation levels in consideration of masking and a directional band calculated from the head-related transfer function.

Although the directional band of the backward direction for this person being tested is 11.2 kHz (line of 180 degrees in the drawing), the level of band slightly upwards from the front direction (line of 30 degrees in the drawing) is boosted in this band as will be seen from the FIG. 13, and the hypothesis proposed by Blauert is inconsistent.

It can be thought that the inconsistency in the hypothesis proposed by Blauert is caused by the fact that masking, which is one of auditory perception phenomena, is not considered. According to "Dictionary of Acoustic Terms" edited by the Acoustical Society of Japan (CORONA PUBLISHING CO., LTD), the masking is defined as a phenomenon that the minimum audible threshold of a sound is increased by the existence of other sounds. In particular, numerous conventional researches have made apparent a phenomenon that a sound of a given frequency component masks sounds of frequencies in the vicinity of the given frequency, especially higher than the given frequency. "An Introduction to the Psychology of Hearing" written by Moore (Academic Press) is popular as a renowned document on the masking.

Also, as for the head-related transfer function, it is thought that influences of the masking cannot be ignored because sharp peaks and notches occur especially in frequency band equal to or greater than 5 kHz.

The inventor of the present application has attempted to calculate sensation levels in view of the masking based on the head-related transfer function, in order to clarify the relationship with the directional band. Here, the sensation level is intended to mean an intensity level of a sound evaluated on the basis of the minimum audible threshold of the sound, as defined in the above-mentioned "Dictionary of Acoustic Terms". The sensation level for which masking is taken into consideration is calculated in the manner as follows.

Firstly, the amounts of masking caused by individual frequency components of the head-related transfer function affecting neighboring frequencies are separately calculated. Then, the total amount of masking is calculated by adding up the amounts of masking. The sensation level for which masking is taken into consideration is obtained by subtracting the total amount of masking from the level of each of the frequency components of the head-related transfer function.

As an example, the directional band of the backward direction and the sensation level for which masking is taken into consideration calculated based on the head-related transfer function of the person being tested shown in FIG. 12 is shown in FIG. 13. Here, the sensation levels indicated in equally-spaced bands of 750 Hz are calculated in consideration of ISO/IEC MPEG-1 Psychoacoustic Model (ISO/IEC 11172-3:1993(E)). It is herein to be noted that the band levels obtained by correcting the band levels calculated based on the head-related transfer function of the person being tested shown in FIG. 12 in consideration of the influence of the masking correspond to the sensation levels in consideration of masking.

Unlike the case shown in FIG. 12, the numerical value of the backward direction (line of 180 degrees in the drawing) is maximized at 11625 Hz (in the frequency bands equal to or greater than 5 kHz), which is substantially matched with the directional band of the backward direction of 11.2 kHz.

From the foregoing description, the inventor of the present application has reached a conclusion that the cue information to be used for localizing a sound image in for- and backward and up- and downward directions can be explained based on the relationship between the sensation level for which masking is taken into consideration calculated from the head-related transfer function and the directional band. In the concrete, a band, in which the sensation level for which masking is taken into consideration calculated from the head-related transfer function of a given direction is maximized, is matched with the directional band of the given direction.

As will be appreciated from the foregoing description, it is concluded that, in order to localize a sound image in arbitrary for- and backward and up- and downward directions, the head-related transfer function of a listener in person is not necessarily required if control filter coefficients are calculated in view of the sensation level for which masking is taken into consideration and the directional band. In the concrete, the control filter coefficient should be calculated in such a manner that a frequency, at which the sensation level for which masking is taken into consideration calculated from the control filter coefficient is maximized, is matched with the directional band of a position at which the sound image is desired to be localized.

Further, even though the head-related transfer functions may vary between individual listeners, the sound image can be equally localized using the control filter coefficient common to all of them as long as the relationship between the aforementioned sensation level for which masking is taken into consideration and the directional band is likewise applicable, thereby enabling to realize a sound image localization apparatus which can localize a sound image correctly for many listeners with ease.

According to the conventional technology (for example, disclosed in U.S. Pat. No. 3,388,235), it has become apparent that the control along the left- and rightward direction (corresponding to lateral angle in the aforementioned patent specification) and the control along the for- and backward and up- and downward direction (corresponding to vertical angle in the aforementioned patent specification) can be carried out independently from each other if the interaural time difference and the interaural sound level difference are applied. Accordingly, it is apparent that the sound image localization apparatus according to the present invention can localize a sound image at an arbitrary position in a three-dimensional space by adding the function of localizing the sound image along the lateral direction using the aforementioned interaural time difference and interaural sound level difference to the sound image localization apparatus according to the present invention.

Preferred embodiments of the present invention will be described hereinafter with reference to accompanying drawings.

First Preferred Embodiment

FIG. 1 is a block diagram showing a first preferred embodiment of the sound image localization apparatus according to the present invention.

As shown in FIG. 1, the present embodiment of the sound image localization apparatus comprises directional band information storage means constituted by a directional band information storage unit 11 for storing therein information of the directional band, control filter computing means constituted by a control filter computing unit 12 for reading the information of the directional band corresponding to inputted target position information from the directional band information storage unit 11, and calculating a control filter coefficient based on the information of the directional band thus read, and sound image localization processing means constituted by a sound image localization processing unit 13 for carrying out a sound image localization processing on an inputted sound source signal using the control filter coefficient calculated by the control filter computing unit 12, and outputting a sound image localization signal.

In the sound image localization apparatus thus constructed, the directional band information storage unit 11 has therein stored information of a plurality of directional bands which have been in advance calculated for respective directions.

The control filter computing unit 12 is adapted to input target position information, read a directional band corresponding to the target position information from the directional band information storage unit 11, and calculate a control filter coefficient in such a manner that the maximum sensation level for which masking is taken into consideration is matched with the directional band thus read.

Figure 14:
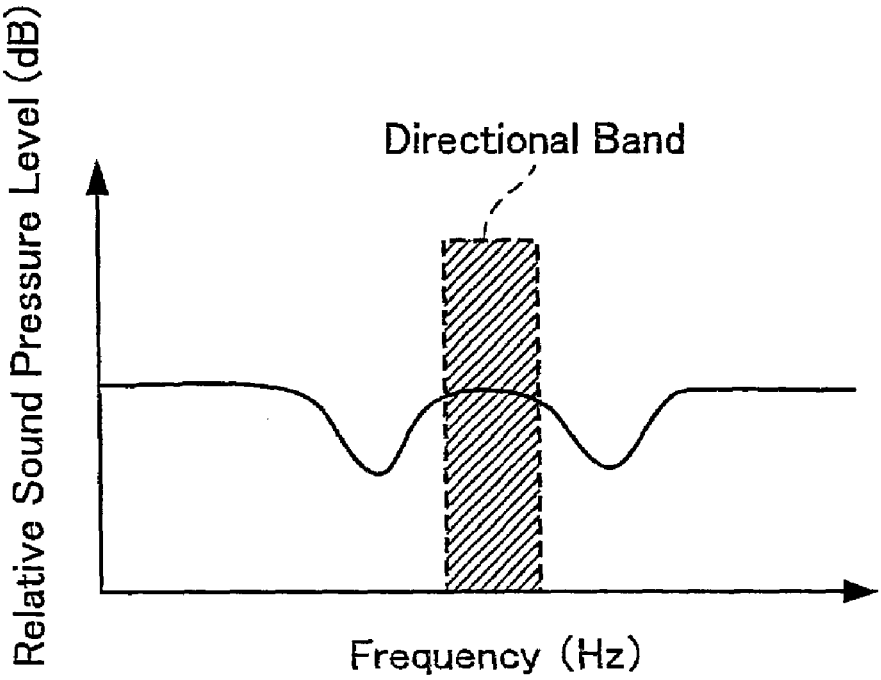
FIG. 14 is graph showing an example of a control filter coefficient.
Figure 15:
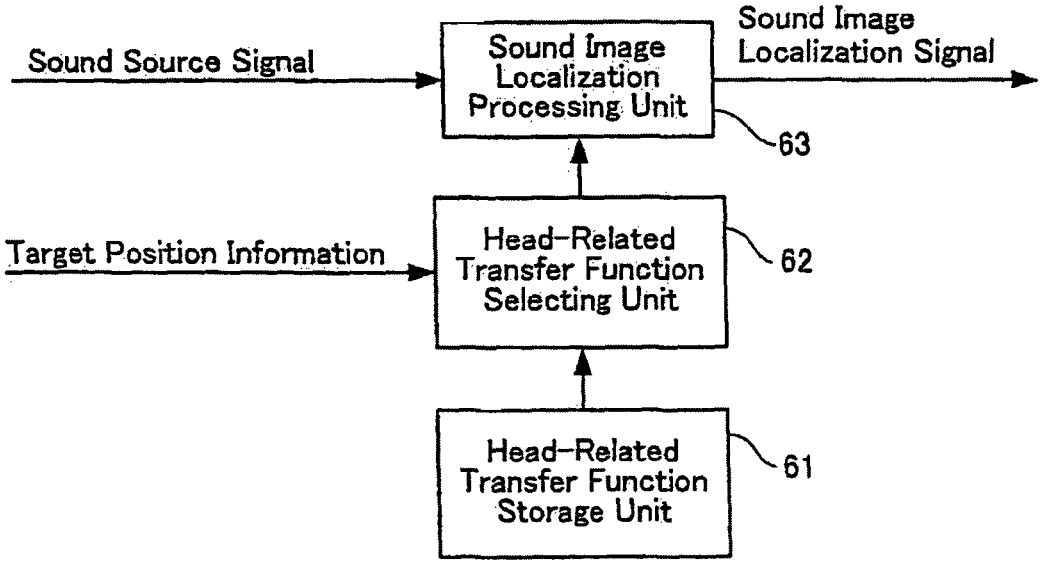
FIG. 15 is a block diagram showing a conventional sound image localization apparatus.

In the case that, for example, a filter adapted to suppress bands respectively disposed at both ends of the directional band, as shown in FIG. 14, is applied, the amount of masking in the directional band is decreased, and the sensation level for which masking is taken into consideration in the directional band is thus increased, thereby making it possible to localize a sound image at a position corresponding to the directional band. Further, the same effect can still be obtained even if a filter adapted to suppress either one of bands respectively disposed at both ends of the directional band is applied.

The control filter computing unit 12 is adapted to output the control filter coefficient thus calculated to the sound image localization processing unit 13.

Upon inputting the control filter coefficient from the control filter computing unit 12, the sound image localization processing unit 13 is adapted to carry out sound image localization processing by convolving the control filter coefficient to an inputted sound source signal, and output a sound image localization signal, which is a sound signal whose sound image has been localized, to a sound reproducing device, not shown, such as, for example, headphones, a speaker, and/or the like.

As will be appreciated from the foregoing description, it is to be understood that the present embodiment of the sound image localization apparatus according to the present invention can localize a sound image at a target position with ease while eliminating the need for the head-related transfer function, which requires time-consuming processes for measurement and large amount of data, resulting from the fact that the control filter coefficient is calculated in such a manner that the sensation level for which masking is taken into consideration is maximized in the directional band corresponding to the target position, and then the sound image is localized by convolving the control filter coefficient thus calculated to the sound source signal.

Further, the present embodiment of the sound image localization apparatus according to the present invention can localize a sound image correctly for many listeners if directional bands suitable for many listeners are stored in the directional band information storage unit 11.

Second Preferred Embodiment

Figure 2:
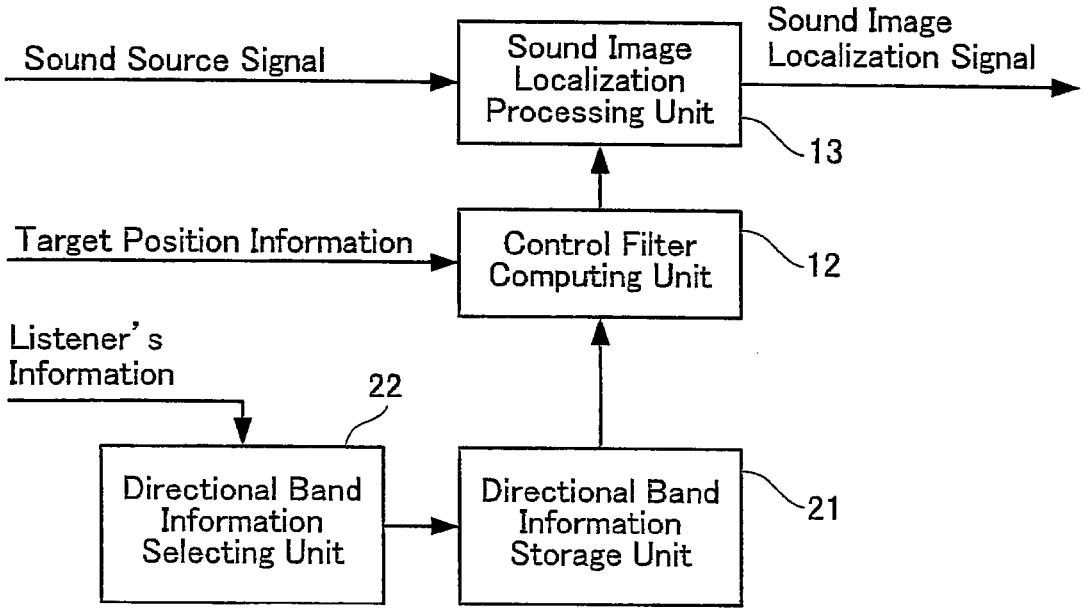
FIG. 2 is a block diagram showing a second preferred embodiment of a sound image localization apparatus according to the present invention.

FIG. 2 is a block diagram showing a second preferred embodiment of the sound image localization apparatus according to the present invention. The present embodiment of the sound image localization apparatus is substantially the same in construction as the first embodiment of the sound image localization apparatus. Therefore, the same constitutional elements are simply represented by the same reference numerals as those of the first embodiment, and only characterizing elements will be described hereinafter.

The present embodiment of the sound image localization apparatus further comprises directional band information selecting means constituted by a directional band information selecting unit 22 for creating and outputting information of listener's characteristics, which may cause a change in the directional band, based on information of the listener such as, for example, physical characteristics of the listener, and directional band information storage means constituted by a directional band information storage unit 21 for storing therein information of a plurality of directional bands classified in association with respective characteristics of the listener, which may cause a change in the directional bands, and outputting the information of a directional band, which is suitable to the listener's characteristics received from the directional band information selecting unit 22.

In the concrete, the directional band information storage unit 21 is adapted to store therein a plurality of directional bands for respective directions in advance calculated, in association with characteristics of listeners (for example, sizes of ears, a profile of a face, etc.) as classification items (directional band information).

The directional band information selecting unit 22 is adapted to input image information indicative of physical characteristics (for example, a face, a whole body, etc.) of a listener as information of the listener, and the directional band information selecting unit 22 is adapted to extract listener's characteristics (for example, sizes of ears, profile of face, body height, etc.), which may cause a change in the directional band, to be used as classification items of the directional band information in advance stored in the directional band information storage unit 21, from the image information, and output the listener's characteristics thus extracted as listener's characteristics information to the directional band information storage unit 21.

The directional band information storage unit 21 is adapted to output a directional band of a direction specified upon a request from the control filter computing unit 12, selected from the directional band information corresponding to the listener's characteristics information thus inputted.

The control filter computing unit 12 is adapted to read the directional band corresponding to an inputted target position, and calculate a control filter coefficient to be outputted to the sound image localization processing unit 13, in the same manner as described in the previous embodiment.

Upon receiving the control filter coefficient from the control filter computing unit 12, the sound image localization processing unit 13 is adapted to convolve the control filter coefficient thus received to an inputted sound source signal, in the same manner as described in the previous embodiment.

As will be appreciated from the foregoing description, it is to be understood that the present embodiment of the sound image localization apparatus according to the present invention can localize a sound image correctly for many listeners, resulting from the fact that information of a plurality of directional bands classified in association with respective characteristics of the listener, which may cause a change in the directional band, is prepared, listener's characteristics, which may cause a change in the directional band, is extracted from information of the listener such as, for example, physical characteristics of the listener, the control filter coefficient is calculated in such a manner that the sensation level for which masking is taken into consideration is maximized in the directional band of the directional band information corresponding to the listener's characteristics thus extracted, and the control filter coefficient thus calculated is convolved to the sound source signal to have the sound image localized.

While it has been described in the present embodiment that image information is inputted as information of a listener, and listener's characteristics are extracted from the image information, the directional band information selecting unit 22 may present characterized items (for example, sizes of ears, profile of face, body height, etc.), which may cause a change in the directional band, to have a listener him- or herself input his or her own characteristics for each of the characterized items, to ensure that the directional band of a specified direction is selected from the directional band information corresponding to the characteristics thus inputted.

Further, as classification items may be used characteristics in terms of auditory perception affecting a sound image (for example, differences in directional band), in place of physical characteristics of a listener.

Third Preferred Embodiment

Figure 3:
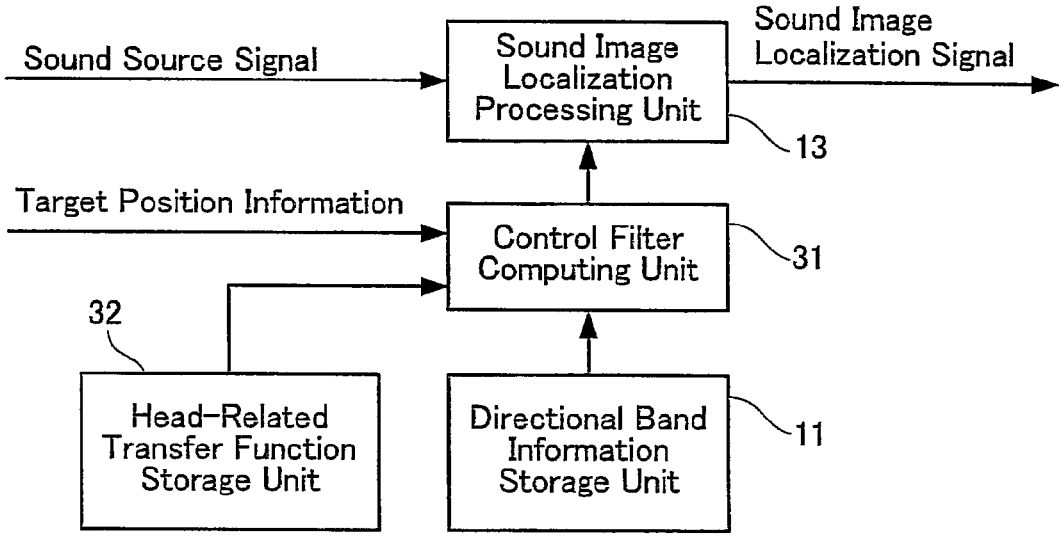
FIG. 3 is a block diagram showing a third preferred embodiment of a sound image localization apparatus according to the present invention.

FIG. 3 is a block diagram showing a third preferred embodiment of the sound image localization apparatus according to the present invention. The present embodiment of the sound image localization apparatus is substantially the same in construction as the first embodiment of the sound image localization apparatus. Therefore, the same constitutional elements are simply represented by the same reference numerals as those of the first embodiment, and only characterizing elements will be described hereinafter.

The present embodiment of the sound image localization apparatus further comprises a head-related transfer function storage unit 32 for storing therein head-related transfer functions, and the control filter computing means constituted by a control filter computing unit 31 is adapted to calculate a sensation level for which masking is taken into consideration based on the head-related transfer function stored in the head-related transfer function storage unit 32, and calculate a control filter coefficient by correcting the head-related transfer function in such a manner that the maximum value of the sensation level thus calculated is matched with the directional band read from the directional band information storage unit 11.

In the concrete, the directional band information storage unit 11 is adapted to store therein a plurality of directional bands of respective directions in advance calculated, in the same manner as described in the previous embodiment.

The head-related transfer function storage unit 32 is adapted to store therein standard head-related transfer function.

Upon receiving target position information, the control filter computing unit 31 is adapted to read directional band corresponding to the target position information from the directional band information storage unit 11, read a head-related transfer function from the head-related transfer function storage unit 32, calculate a sensation level for which masking is taken into consideration from the head-related transfer function thus read, and calculate and output a control filter coefficient by correcting the head-related transfer function in such a manner that the maximum value of the sensation level thus calculated is matched with the directional band thus read.

Upon receiving the control filter coefficient from the control filter computing unit 31, the sound image localization processing unit 13 is adapted to convolve the control filter coefficient thus received to an inputted sound source signal, in the same manner as described in the previous embodiment.

As will be appreciated from the foregoing description, it is to be understood that the present embodiment of the sound image localization apparatus according to the present invention can correct the individual variability in the head-related transfer function based on the directional band, and thus localize a sound image correctly for many listeners, resulting from the fact that the control filter coefficient is calculated by correcting the head-related transfer function in such a manner that the maximum value of the sensation level for which masking is taken into consideration calculated from the head-related transfer function is matched with the directional band.

Figure 4:
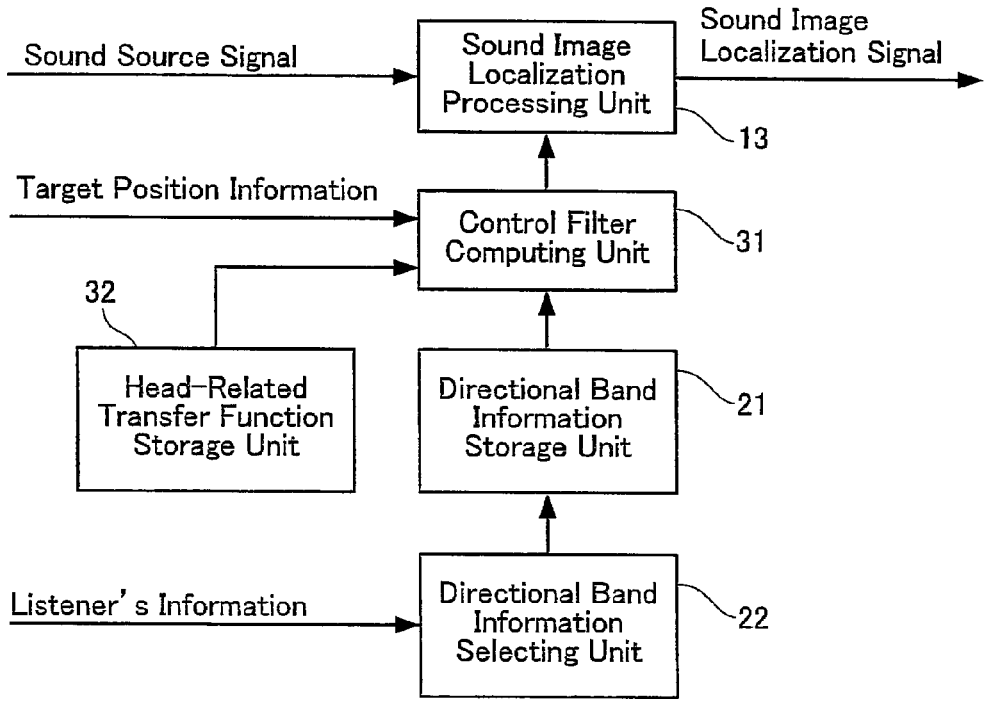
FIG. 4 is a block diagram showing a modification of the third preferred embodiment of a sound image localization apparatus according to the present invention.

As a modification of the present embodiment, the directional band information storage unit 21 and the directional band information selecting unit 22 of the second embodiment may be provided in place of the directional band information storage unit 11, as show in FIG. 4. The modification of the present embodiment of the sound image localization apparatus thus constructed can correct the individual variability in the head-related transfer function based on the directional band corresponding to the listener's characteristics, and thus localize a sound image correctly for many listeners.

Further, while it has been described in the present embodiment that the standard head-related transfer function is stored in the head-related transfer function storage unit 32, the head-related transfer function storage unit 32 may have stored therein a head-related transfer function common to all the directions, which include characteristics common to all the directions, or a plurality of head-related transfer functions respectively classified in accordance with listener's characteristics, as in the case of the directional band information storage unit 21 of the second embodiment.

Fourth Preferred Embodiment

Figure 5:
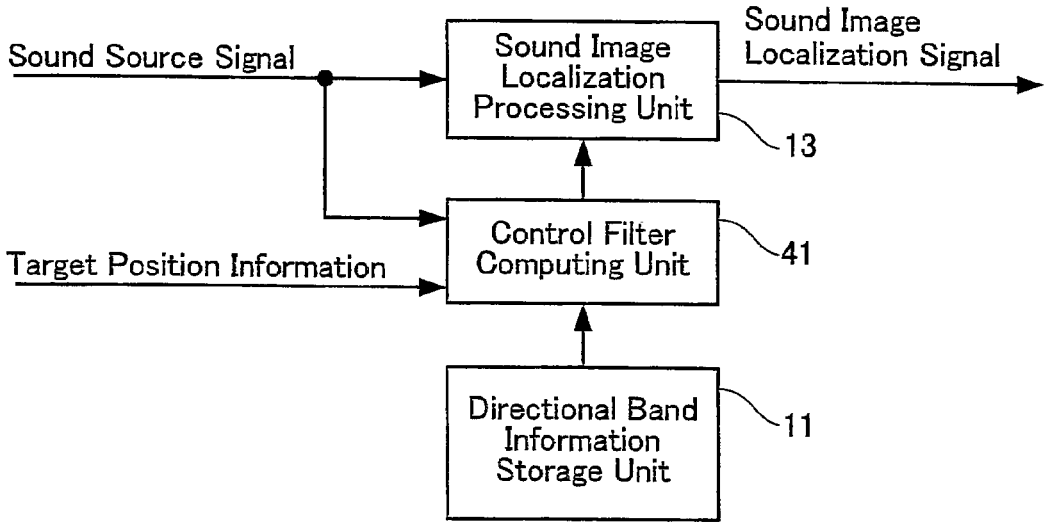
FIG. 5 is a block diagram showing a fourth preferred embodiment of a sound image localization apparatus according to the present invention.

FIG. 5 is a block diagram showing a fourth preferred embodiment of the sound image localization apparatus according to the present invention. The present embodiment of the sound image localization apparatus is substantially the same in construction as the first embodiment of the sound image localization apparatus. Therefore, the same constitutional elements are simply represented by the same reference numerals as those of the first embodiment, and only characterizing elements will be described hereinafter.

The present embodiment of the sound image localization apparatus comprises control filter computing means constituted by a control filter computing unit 41 for inputting a sound source signal, and calculating a control filter coefficient in such a manner that the maximum value of the sensation levels in consideration of masking calculated from the sound source signal is suppressed outside of the directional band.

In the concrete, directional bands in advance calculated for respective directions are stored in the directional band information storage unit 11, in the same manner as described in the previous embodiment.

Further, upon receiving target position information, the control filter computing unit 41 is adapted to read a directional band corresponding to the target position information from the directional band information storage unit 11, calculate a sensation level for which masking is taken into consideration from an inputted sound source signal, and calculate and output a control filter coefficient in such a manner that the maximum value of the sensation level for which masking is taken into consideration is matched with the directional band thus read as well as, if the sensation level for which masking is taken into consideration has a maximum value in a band other than the directional band thus read, the maximum values is suppressed.

Upon receiving the control filter coefficient from the control filter computing unit 41, the sound image localization processing unit 13 is adapted to convolve the control filter coefficient thus received to an inputted sound source signal, to be outputted therethrough, in the same manner as described in the previous embodiment.

As will be appreciated from the foregoing description, it is to be understood that the present embodiment of the sound image localization apparatus according to the present invention can localize a sound image at a target position with ease regardless of the sound source signal, resulting from the fact that the sound source signal is analyzed and the control filter coefficient is calculated in such a manner that if the sensation level for which masking is taken into consideration has a maximum value in a band other than the directional band corresponding to the target position the maximum value is suppressed.

Figure 6:
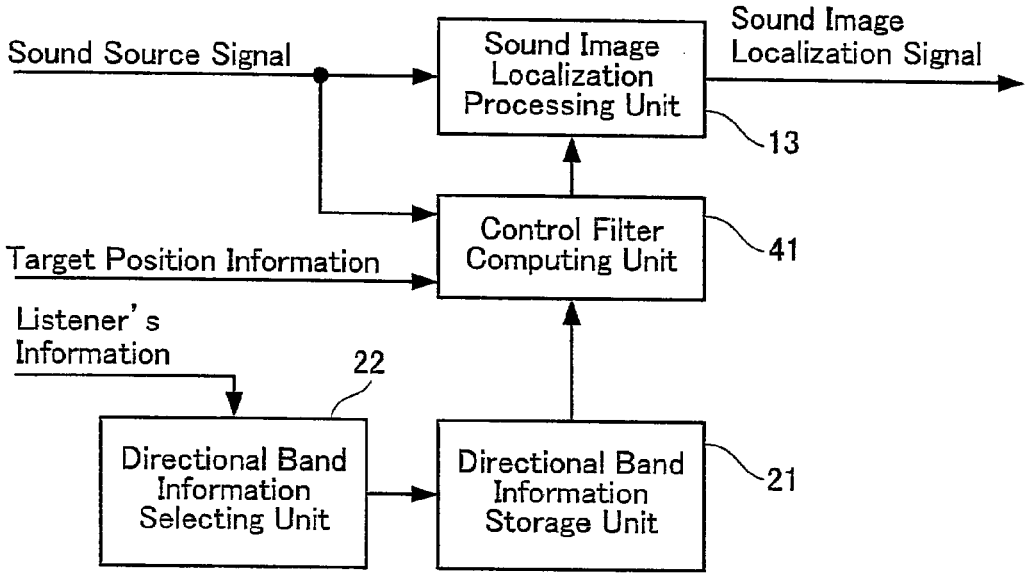
FIG. 6 is a block diagram showing a first modification of the fourth preferred embodiment of a sound image localization apparatus according to the present invention.

As a first modification of the present embodiment, the directional band information storage unit 21 and the directional band information selecting unit 22 of the aforementioned second embodiment may be provided in place of the directional band information storage unit 11, as shown in FIG. 6. The first modification of the present embodiment of the sound image localization apparatus thus constructed can localize a sound image correctly for many listeners.

Figure 7:
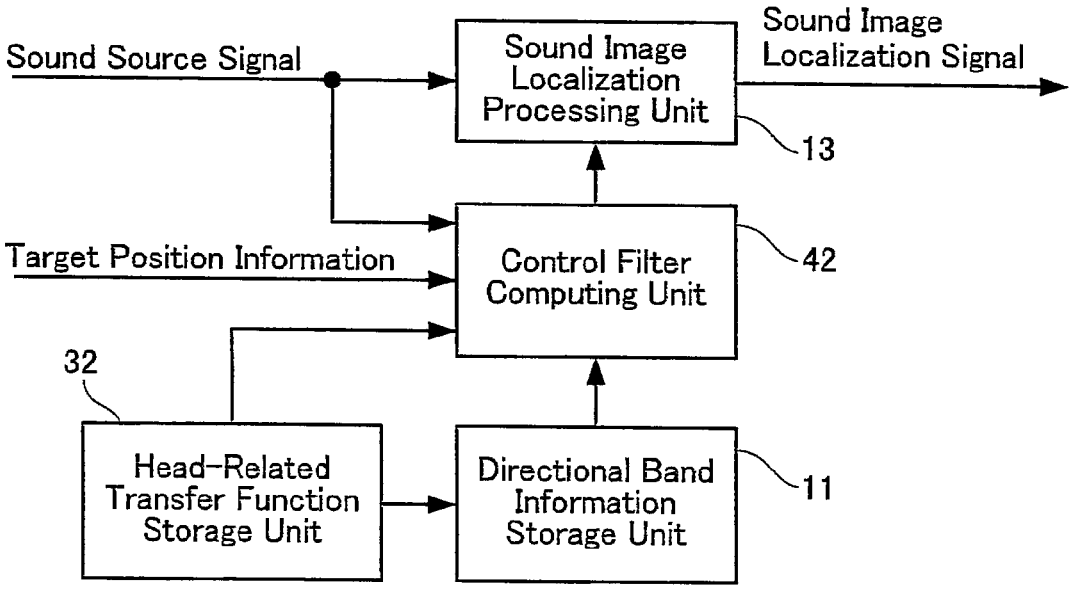
FIG. 7 is a block diagram showing a second modification of the fourth preferred embodiment of a sound image localization apparatus according to the present invention.

As a second modification of the present embodiment, as shown in FIG. 7, a head-related transfer function storage unit 32 of the aforementioned third embodiment may be further provided, and a control filter computing unit 42 constituting control filter computing means may be operative to calculate a control filter coefficient by correcting a head-related transfer function in such a manner that the maximum value of the sensation level for which masking is taken into consideration of the head-related transfer function stored in the head-related transfer function storage unit 32 is matched with the directional band read from the directional band information storage unit 11 in the same manner as described in the aforementioned third embodiment. The second modification of the present embodiment of the sound image localization apparatus thus constructed can localize a sound image correctly for many listeners.

While it has been described in the present embodiment that if the sensation level for which masking is taken into consideration has a maximum value in a band other than the directional band corresponding to the target position the maximum value is suppressed, the aforementioned sensation levels in consideration of masking may be compared with a predetermined value in bands other then the directional band corresponding to the target position, and the sensation levels in consideration of masking, which are judged as being greater than the predetermined value in respective bands, may be suppressed.

Further, the present invention is not limited by the aforementioned methods, processing of suppressing cue information contained in the sound source signal, which causes the sound image to be localized at a position different from the target position, may be further provided.

Fifth Preferred Embodiment

Figure 8:
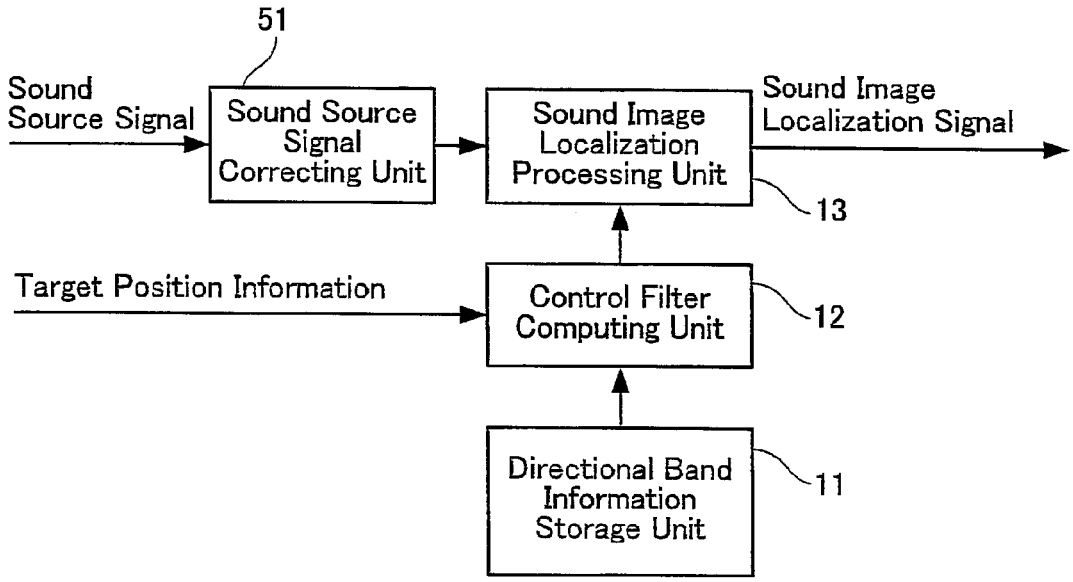
FIG. 8 is a block diagram showing a fifth preferred embodiment of a sound image localization apparatus according to the present invention.

FIG. 8 is a block diagram showing a fifth preferred embodiment of the sound image localization apparatus according to the present invention. The present embodiment of the sound image localization apparatus is substantially the same in construction as the first embodiment of the sound image localization apparatus. Therefore, the same constitutional elements are simply represented by the same reference numerals as those of the first embodiment, and only characterizing elements will be described hereinafter.

The present embodiment of the sound image localization apparatus further comprises sound source signal correcting means constituted by a sound source signal correcting unit 51 for frequency-analyzing an inputted sound source signal, comparing a band level of the sound source signal with a predetermined value in each of bands, and suppressing and outputting the band levels judged as being greater than the predetermined value in respective bands if there are any bands whose band levels are judged as being greater.

In the concrete, the directional band information storage unit 11 is adapted to store therein a plurality of directional bands in advance calculated for respective directions, in the same manner as described in the previous embodiment.

The control filter computing unit 12 is adapted to read the directional band corresponding to an inputted target position, and calculate a control filter coefficient to be outputted to the sound image localization processing unit 13, in the same manner as described in the previous embodiment.

The sound source signal correcting unit 51 is adapted to frequency-analyze an inputted sound source signal, compare a band level of the sound source signal with a predetermined value in each of bands, and suppress the band levels judged as being greater than the predetermined value in respective bands to the degree, for example, less than the predetermined value if there are any bands whose band levels are judged as being greater, to be outputted therethrough to the sound image localization processing unit 13.

Upon receiving a control filter coefficient from the control filter computing unit 12, the sound image localization processing unit 13 is adapted to convolve the control filter coefficient thus received to an inputted sound source signal (the sound source signal corrected by the sound source signal correcting unit 51), to be outputted therethrough, in the same manner as described in the previous embodiment.

As will be appreciated from the foregoing description, it is to be understood that the present embodiment of the sound image localization apparatus according to the present invention can localize a sound image at a target position with ease regardless of the sound source signal, resulting from the fact that the sound source signal is frequency-analyzed and, if the sound source signal has peak levels in any part, the peak levels are suppressed before convolving the computed control filter coefficient to the sound source signal.

Further, while it has been described in the present embodiment that the levels of the sound source signal in bands, which are greater than the predetermined value, are suppressed, sensation levels in consideration of masking of the sound source signal may be calculated, the sensation levels thus calculated may be compared with a predetermined value in respective bands, and the sensation levels in bands judged as being greater than the predetermined value may be suppressed.

Further, the sound source signal correcting unit 51 may input a directional band corresponding to a target position from the control filter computing unit 12, and suppress a maximum value in bands other than the directional band.

Further, the present invention is not limited by the aforementioned methods, processing of suppressing cue information contained in the sound source signal, which causes the sound image to be localized at a position different from the target position, may be further provided.

Further, band may be further divided to a plurality of sub-bands, and each of the sub-bands may have a unique threshold value to be used for suppression.

Figure 9:
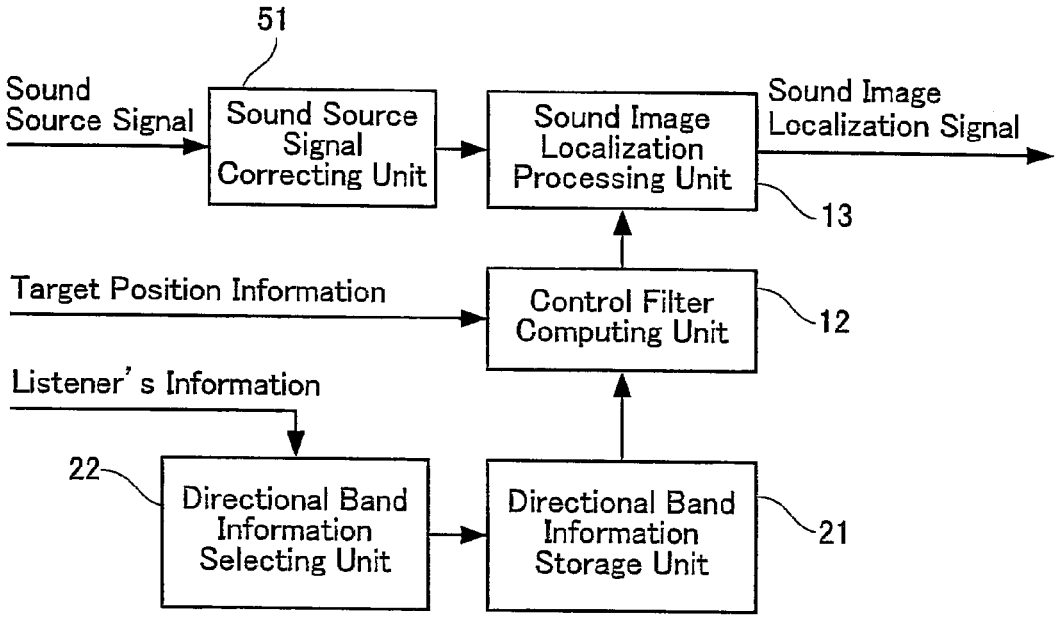
FIG. 9 is a block diagram showing a first modification of the fifth preferred embodiment of the sound image localization apparatus according to the present invention.

As a first modification of the present embodiment, the directional band information storage unit 21 and the directional band information selecting unit 22 of the aforementioned second embodiment may be provided in place of the directional band information storage unit 11, as shown in FIG. 9. The modification of the present embodiment of the sound image localization apparatus thus constructed can localize a sound image correctly for many listeners.

Figure 10:
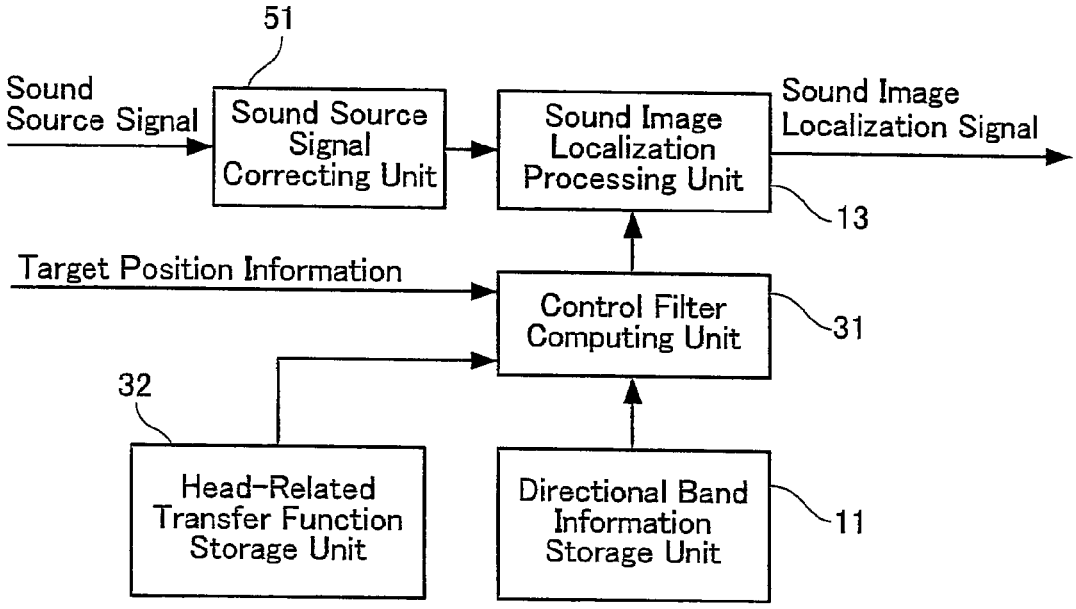
FIG. 10 is a block diagram showing a second modification of the fifth preferred embodiment of the sound image localization apparatus according to the present invention.

As a second modification of the present embodiment, as shown in FIG. 10, the control filter computing unit 31 and the head-related transfer function storage unit 32 of the aforementioned third embodiment may be provided, and the control filter computing unit 31 may be operative to calculate a control filter coefficient by correcting the head-related transfer function in such a manner that the maximum value of the sensation level for which masking is taken into consideration of the head-related transfer function stored in the head-related transfer function storage unit 32 is matched with the directional band read from the directional band information storage unit 11, in the same manner as described in the aforementioned third embodiment. The modification of the present embodiment of the sound image localization apparatus thus constructed can localize a sound image correctly for many listeners.

Figure 11:
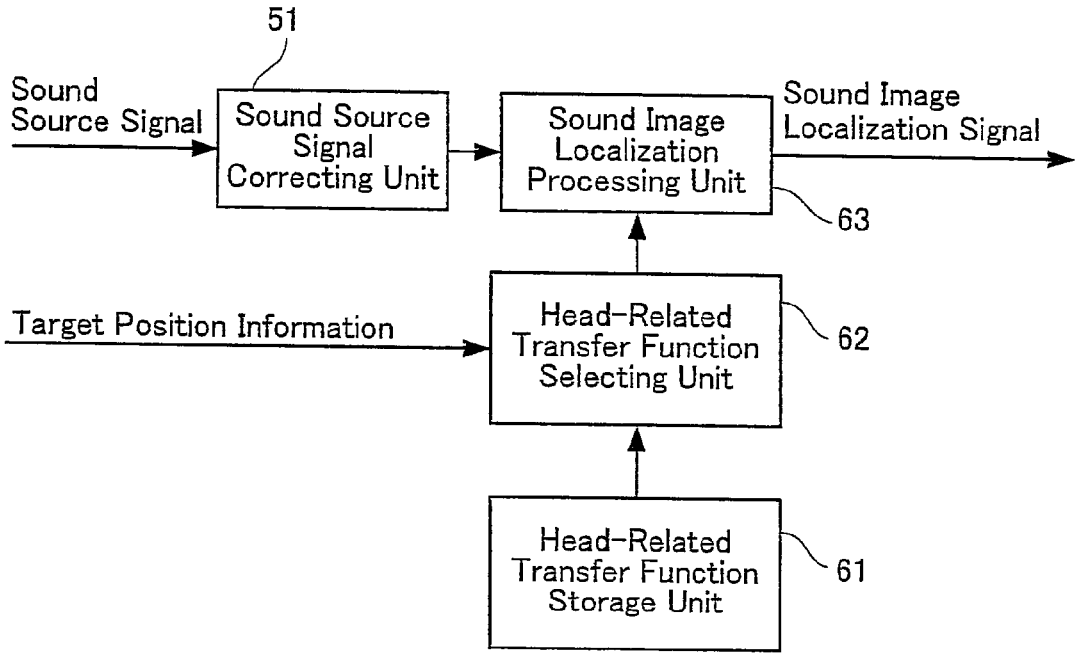
FIG. 11 is a block diagram showing a third modification of the fifth preferred embodiment of the sound image localization apparatus according to the present invention.

As third modification of the present embodiment, the directional band information storage unit 61, the head-related transfer function selecting unit 62, and the sound image localization processing unit 63 of the aforementioned conventional sound image localization apparatus may be provided, as shown in FIG. 11. The modification of the present embodiment of the sound image localization apparatus thus constructed can localize a sound image correctly for many listeners although the construction is the same as that of the conventional sound image localization apparatus.

As will be appreciated from the foregoing description, it is to be understood that the present embodiment of the sound image localization apparatus according to the present invention can localize a sound image correctly at a target position even though the inputted sound source signal may contain cue information, which causes the sound image to be localize, for example, at a position different from the target position, resulting from the fact that the present embodiment of the sound image localization apparatus comprises a sound source signal correcting unit 51 for frequency-analyzing an inputted sound source signal, comparing a band level of the sound source signal with a predetermined value in each of bands, and suppressing the band levels judged as being greater than the predetermined value in respective bands if there are any bands whose band levels are judged as being greater, to be outputted therethrough.

According to "An Introduction to the Psychology of Hearing," it has become apparent that the human auditory perception is similar in function to a band-pass filter referred to as "auditory filter," and carrying out some sorts of smoothing operation on frequency components of signals inputted to ears. This means that, in each of the aforementioned embodiments, the control filter computing unit can calculate a control filter coefficient with accuracy sufficient for the auditory perception, although details of the frequency components of an inputted sound source signal, head-related transfer function, sensation level for which masking is taken into consideration, and directional band, may not be considered.

This leads to the fact that the control filter computing unit may divide at least one of the frequency components of an inputted sound source signal, the head-related transfer function, the sensation level for which masking is taken into consideration, and the directional band, for a plurality of bands, and calculate a control filter coefficient based on band levels and/or band information of respective bands. Further, the control filter computing unit may calculate a control filter coefficient for each of the bands.

Further, the control filter computing unit may have in advance calculated a plurality of control filter coefficients, select a control filter coefficient in accordance with a target position from among them, and output the control filter coefficient thus selected to the sound image localizing processing unit.

Further, in each of the aforementioned embodiments, constituent elements other than the sound image localization processing unit may be constituted by a sound image localization assisting apparatus for calculating a control filter, or a sound image localization information server for providing control filter information by way of, for example, communication, or the like. The sound image localization apparatus according to the present invention thus constructed makes it possible for parts to be mounted on ears to be constructed small in size, resulting from the fact that the sound image localization processing unit and the sound image localization assisting apparatus can be constructed and disposed separately from each other, and the sound image localization assisting apparatus can remotely provide a calculated filter coefficient to the sound image localization processing unit.

The sound source signal correcting unit 51 of the fifth embodiment may be constituted by a sound source signal correcting apparatus disposed independently from other constituent elements.

INDUSTRIAL APPLICABILITY

As will be appreciated from the foregoing description, it will be understood that the sound image localization apparatus according to the present invention has advantageous effects of localizing a sound image correctly for many listeners, and is useful for all of sound reproducing devices such as, for example, mobile cellular phone, game machine, CD (Compact Disc) player, and the like in localizing a sound image at an arbitrary position in a three-dimensional space.

What is claimed is:

1. A sound image localization apparatus, comprising:

directional band information storage means for storing therein information of directional bands;

control filter computing means for reading said directional band corresponding to an inputted target position from said directional band information storage means, and computing a control filter coefficient based on said directional band thus read and a sensation level for which it is considered that masking occurs; and sound image localization processing means for carrying out sound image localization processing on an inputted sound source signal using said control filter coefficient, in which said control filter computing means is operative to calculate said control filter coefficient in such a manner that a frequency band, in which said sensation level is maximized, is substantially identified with said directional band corresponding to said target position.

2. A sound image localization apparatus as set forth in claim 1, further comprising head-related transfer function storage means for storing therein head-related transfer functions, in which said sensation level is calculated from said head-related transfer function obtained from said head-related transfer function storage means.

3. A sound image localization apparatus as set forth in claim 1, in which said control filter computing means is operative to divide at least one of said sensation level and said directional band corresponding to said target position for a plurality of bands, and calculate said control filter coefficient based a band level or band information of each of said bands.

4. A sound image localization apparatus as set forth in claim 2, in which said control filter computing means is operative to divide at least one of said head-related transfer function, said sensation level and said directional band corresponding to said target position for a plurality of bands, and calculate said control filter coefficient based on a band level or band information of each of said bands.

5. A sound image localization apparatus as set forth in claim 1, in which said sound source signal is further inputted to said control filter computing means, and said control filter computing means is operative to calculate said sensation level from said sound source signal, and suppress a maximum value of said sensation level disposed in a band other than said directional band corresponding to said target position.

6. A sound image localization apparatus as set forth in claim 1, in which said sound source signal is further inputted to said control filter computing means, and said control filter computing means is operative to calculate said sensation level from said sound source signal, compare said sensation level disposed in a band other than said directional band corresponding to said target position with a predetermined value, and suppress said sensation level judged as being greater than said predetermined value.

7. A sound image localization apparatus as set forth in claim 1, in which said control filter computing means is operative to divide frequency characteristics of said sound source signal for a plurality of bands, and calculate said control filter coefficient based on a band level or band information of each of said bands.

8. A sound image localization apparatus as set forth in claim 1, in which said control filter computing means is operative to calculate, as said control filter coefficient, a control filter coefficient adapted to suppress at least one of bands disposed at respective both ends of said directional band corresponding to said target position.

9. A sound image localization apparatus as set forth in claim 1, in which said control filter computing means is operative to divide said control filter coefficient for a plurality of bands, and calculate said control filter coefficient for each of said bands.

10. A sound image localization apparatus as set forth in claim 1, in which said directional band information storage means is operative to store therein said information of directional bands in association with a plurality of listener groups classified based on respective listener's characteristics, and said sound image localization apparatus further comprising directional band information selecting means for having said directional band information storage means select suitable directional band information from among said information of directional bands in association with said plurality of listener groups in accordance with inputted listener's characteristics.

11. A sound image localization apparatus as set forth in claim 10, in which said listener's characteristics are listener's physical characteristics.

12. A sound image localization apparatus as set forth in claim 11, in which said directional band information selecting means is operative to extract said physical characteristics from inputted image data indicative of a listener.

13. A sound image localization apparatus as set forth in claim 1, further comprising sound source signal correcting means for frequency-analyzing said sound source signal, and correcting said sound source signal by suppressing cue information contained in said sound source signal, which causes a sound image to be localized at a position different from said target position, in which said sound image localization processing means is operative to carry out sound image localization processing on said sound source signal corrected by said sound source signal correcting means.

14. A sound image localization apparatus as set forth in claim 1, further comprising sound source signal correcting means for frequency-analyzing said sound source signal, comparing a band level of said sound source signal with a predetermined value in each of bands, and correcting said sound source signal by suppressing said band levels judged as being greater than said predetermined value in each of bands if there are any bands whose band levels are judged as being greater, in which said sound image localization processing means is operative to carry out sound image localization processing on said sound source signal corrected by said sound source signal correcting means.

15. A sound image localization apparatus as set forth in claim 1, further comprising sound source signal correcting means for frequency-analyzing said sound source signal, calculating said sensation levels of said sound source signal in each of bands, comparing said sensation levels with a predetermined value in each of bands, and correcting said sound source signal by suppressing said sensation levels judged as being greater than said predetermined value in each of bands if there are any sensation levels in bands judged as being greater, in which said sound image localization processing means is operative to carry out sound image localization processing on said sound source signal corrected by said sound source signal correcting means.

16. A sound image localization apparatus as set forth in claim 1, in which said directional band information storage means and said control filter computing means constitute a sound image localization assisting apparatus, and said sound image localization assisting apparatus is operative to communicate with said sound image localization processing means to transmit said filter coefficient to said sound image localization processing means.

* * * * *